US005768816A

United States Patent [19]

Rassias

[11] Patent Number: 5,768,816

[45] Date of Patent: Jun. 23, 1998

[54] SECURITY AND DEPLOYMENT ASSEMBLY

[76] Inventor: John N. Rassias, 7700 Cedarwood Cir., Boca Raton, Fla. 33434

[21] Appl. No.: 743,797

[22] Filed: Nov. 5, 1996

Related U.S. Application Data

[63] Continuation-in-part of Ser. No. 463,997, Jun. 5, 1995, Pat. No. 5,611,164.

[51] Int. Cl.[6] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 633,939 | 9/1899 | Ackerman | 42/70.11 |
| 2,577,869 | 12/1951 | Adams | 224/2.2 |
| 2,893,615 | 7/1959 | Couper | 224/2 |
| 3,708,901 | 1/1973 | Wolter | 42/1 N |
| 3,763,587 | 10/1973 | Firmalino | 42/1 R |
| 3,804,306 | 4/1974 | Azurin | 224/2 B |
| 4,321,765 | 3/1982 | Gillum | 42/72 |
| 4,398,366 | 8/1983 | Wernicht | 42/1 LP |
| 4,579,037 | 4/1986 | Gillum | 89/180 |
| 4,858,799 | 8/1989 | Young | 224/243 |
| 4,912,867 | 4/1990 | Dukes, Jr. | 42/70.11 |
| 4,999,940 | 3/1991 | Madden | 42/70.11 |
| 5,044,106 | 9/1991 | Slocum | 42/70.11 |
| 5,052,142 | 10/1991 | Mikus | 42/70.11 |
| 5,395,021 | 3/1995 | Brown | 224/244 |
| 5,446,988 | 9/1995 | Frederick, Jr. | 42/70.11 |
| 5,467,909 | 11/1995 | Resca et al. | 224/244 |

FOREIGN PATENT DOCUMENTS 2082293 3/1982 United Kingdom .

OTHER PUBLICATIONS

Greenberg, "The Tactical Edge", *Combat Handguns*, Jun. 1995, pp. 56 & 86.

Howe, "Officer Slain With Own Gun", *Combat Handguns*, Jun. 1995, pp. 24, 25, 89.

*Combat Handguns*, Jun. 1995, cover page, pp. 5, 7, 10, 11, 26–28, 30, 62, 88, one unnumbered page.

*Primary Examiner*—Charles T. Jordan
*Assistant Examiner*—Meena Chelliah
*Attorney, Agent, or Firm*—Webb Ziesenheim Bruening Logsdon Orkin & Hanson, P.C.

[57] ABSTRACT

A locking assembly for a firearm, such as a closed bolt semiautomatic or open bolt fully automatic pistol, includes in a first embodiment a support member with an action locking arm and an action locking lug extending from a first end of the support member and a retainer arm extending from a second end of the support member. A second embodiment of the locking assembly has a slide shield with the action locking arm and lug at one end and a slide block at the other. The action locking lug and arm are received in the firing chamber of a pistol, while the muzzle end of the pistol is rested on the retainer arm, in the first embodiment, and on the slide block in the second embodiment. A recoil spring in the pistol generates a pincer action between the action locking arm and the retainer arm or slide block to securely maintain the pistol in the locking assembly, preventing withdrawal with the normal upward movement. The pistol may be deployed with one downward thrust on the pistol grip, compressing the recoil spring and providing clearance for removal of the action locking arm and lug. The locking assembly may be incorporated in a holster, or it may be more stationary, such as by mounting on the dashboard of a police squad car.

24 Claims, 12 Drawing Sheets

SECURITY AND DEPLOYMENT ASSEMBLY

RELATED APPLICATION

This is a continuation-in-part of U.S. application Ser. No. 08/463,997, filed Jun. 5, 1995 now U.S. Pat. No. 5,611,164.

BACKGROUND OF THE INVENTION

1. Field of the Invention

This invention is related to a locking assembly for portable firearms, such as semiautomatic pistols or automatic machine pistols and, more particularly, to a locking assembly which safely houses the firearm in an unloaded status, yet provides for drawing and automatically loading and cocking the firearm with only the action of the user's shooting hand.

2. Discussion of Prior Art

The most significant problem with existing military, law enforcement and civilian firearm locking assemblies is security of the weapon while being stored or carried and safety in the deployment of the weapon from the holster. As a fully automatic or semiautomatic pistol is incapable of firing without a cartridge in battery within the pistol's chamber, a dilemma is created with the use of any conventional holster. The term "locking assembly" herein is intended to encompass both apparatus for carrying a firearm on one's person, such as a holster, as well as apparatus for carrying or storing a firearm on items such as automobile dashboards, helicopters, vessel bulkheads, tank turret compartments, closets, furniture and the like. The armed person must decide whether to carry the weapon without a cartridge chambered in battery; in which case the person must, after withdrawing the pistol from the holster, use two hands to hold the pistol and action the slide to chamber a cartridge into battery. In a fast action situation, this maneuver can prove extremely dangerous for the shooter and others nearby and may cost critical time when faced with the threat of immediate forceful action. For example, it is estimated that an average assailant can cover a distance of 21 feet in 1.5 seconds or less—faster than most officers or civilians can react, draw and fire their first shot. Greenberg, "The Tactical Edge", *Combat Handguns*, June 1995, p. 86.

In the case of a single action semiautomatic pistol of the Colt 45 caliber and the 9 mm Browning Hi-Power types, the most prevalent models worldwide, both methods of carry, i.e., with or without a chambered cartridge, are extremely dangerous and prone to a myriad of problems. First, when carried with a cartridge chambered in battery, the hammer is cocked to the utmost rearward position. With a touch of the trigger the hammer will fall, striking the firing pin and discharging the firearm. This is by far the most dangerous carry method. Some personnel chamber a cartridge, engage the hammer safety, thereby restricting the fall of the hammer until the safety is manually disengaged, and place the pistol within the holster. Others chamber a cartridge, leave the safety off and rely on the conventional holster's restraining strap to keep the hammer from falling. This is equally dangerous. The users of the two chambered methods of carry subscribe to a personal philosophy that it is better to have a cartridge within the chamber rather than be required to use the other hand to action the slide to chamber a round. Both methods of carry with a cartridge chambered, whether with the safety or holster strap on or off, are compromised by the dangerous reality that a weapon so carried can easily be involuntarily discharged, often with a tragic outcome.

Military, law enforcement and civilian records are replete with accidents caused by the chambered cartridge carry method. Some personnel have forgotten that a cartridge was chambered and, upon withdrawing the pistol from the holster and removing the magazine from the pistol for cleaning or storage, have inadvertently discharged the chambered round. Others have accidentally dropped the weapon before unloading it, causing the hammer to strike the firing pin and resulting in unintentional injury or death. Other injuries and deaths have been caused by a scuffle between the wearer and an assailant whereby the weapon has fired in the attempt of the assailant to take the weapon out of the holster; and worse, when the assailant has successfully taken the weapon from the wearer and purposely used it against his victim and/or others. In 1986, there were 51 law enforcement officers killed by handguns. Twenty-nine percent (29%) of those deaths occurred with the officer's own handgun. Howe, "Officer Slain with Own Gun", *Combat Handguns*, June 1995, p. 24. To date, very few inventors have come forth with even a reasonably practical solution to this problem. Id.

Many who select the chambered cartridge option believe that perhaps in some forceful circumstance their other hand may be otherwise engaged, as in fending off an assailant, driving, climbing, using a flashlight, etc., or their other hand may be injured, thereby making it physically impossible to chamber a cartridge by actioning the slide. They maintain that although their carry method is inherently dangerous, their weapon is accessible for use with one hand, after they have either released the manual safety or removed the holster strap, or both.

In both single or double action pistols, a cartridge may be pre-chambered and in battery and subject to being fired upon simply pulling the trigger. Consequently, the only other option of carrying a single or double action semiautomatic pistol is to carry it in the conventional holster with no cartridge chambered in battery. Although appearing to be a safer method, it also presents many dangerous possibilities. As both hands are required to chamber a round after the pistol is withdrawn from the conventional holster, the weapon cannot be used at all when one cannot use two hands. Additionally, personnel have inadvertently depressed the magazine release button which on some models is in a direct lateral path of the slide, while actioning the slide with their other hand, only to find their weapon has been rendered useless as the ammunition magazine has dropped out of the weapon. Finally, the only way to assure no round is chambered in semiautomatic or automatic pistols is to forcibly rack the pistol's slide to its most rearward position and visually or manually examine the firing chamber. This is often difficult or overlooked in low light or fast action situations. Extractor and ejector mechanisms on pistols have been known to malfunction due to wear, material fatigue or improper maintenance, giving weapon owners a false sense of security when the pistol slide is racked rearward and no cartridge is ejected. A holster which could obviate the need for visual or manual inspection would be advantageous.

U.S. Pat. No. 3,804,306 to Azurin discloses a conventional automatic pistol holster. The Azurin patent does not teach or suggest the features or advantages of the present invention. U.S. Pat. Nos. 2,577,869 to Adams and 2,893,615 to Couper, each directed to a holster for revolvers, likewise do not teach or suggest the present invention.

The object of the present invention is to allow military, law enforcement and authorized civilian personnel to carry a pistol with maximum safety to themselves and others with no cartridge capable of being in battery within the chamber. It is a further object to provide a locking assembly for a holster wherein a cartridge can be immediately chambered and the pistol withdrawn from the locking assembly using only one hand.

It is a still further object to provide a locking assembly having positive safety mechanisms which not only lock the weapon securely within the assembly but also uniquely prohibit placing a weapon which contains a cartridge within the firing chamber within the assembly.

Further, it is an object of the present invention to provide a pistol which, when placed in the locking assembly, has an inoperable trigger and cannot be withdrawn from the assembly with the usual motion required in conventional holsters.

Further, it is an object of the present invention to provide a locking assembly from which a pistol cannot be withdrawn by an assailant from the front, back or side.

SUMMARY OF THE INVENTION

A locking assembly for a firearm has an action locking arm carrying a lug, the lug being receivable in a firing chamber and a barrel face of the firearm. A slide element blocking device is spaced from and structurally connected with the action locking arm. The slide element blocking device has an opening for passage of a muzzle end of a firearm barrel therethrough. The muzzle end of the barrel extends through the opening when the muzzle end of a spring-loaded, reciprocating slide element on the firearm is placed in contact with the slide element blocking device. When the lug is received within the firing chamber and the barrel face and the muzzle end of the slide element is in contact with the slide element blocking device, the firearm is thereby retained in the locking assembly.

The first embodiment of the invention includes a support member with the action arm extending from a first end of the support member. The action arm carries the lug which is receivable in a firing chamber of the firearm. A retainer arm extends from a second end of the support member and the lug and retainer arm captively retain the firearm between the firing chamber of the firearm and the firearm's muzzle. The lug is receivable in the firearm barrel adjacent the firing chamber. The retainer arm includes a barrel port for passage of the barrel therethrough.

In a second more preferred embodiment of the invention, the locking assembly includes a slide shield with an action locking arm attached to and positioned within the slide shield. The action locking arm carries a lug receivable in a firing chamber and a barrel face of the firearm. A slide block is attached to the slide shield and spaced from the action locking arm and lug. The slide block has a barrel port for passage of a muzzle end of the barrel of the firearm therethrough. The muzzle end of the firearm barrel is extendable into the barrel port when the muzzle end of the slide element on the firearm is placed in contact with the slide block. Thus, when the lug is received in the firing chamber and the barrel face, the muzzle end of the barrel is received in the barrel port and the slide element is in contact with the slide block, the firearm is thereby retained in the locking assembly.

The locking assembly may be incorporated in a holster or attached to a mounting base. The slide shield may have a rectangular cross section with an open end opposite the slide element blocking device and an open side opposite the action locking arm. The slide element and barrel of the firearm are receivable in the open end and open side of the slide shield.

The slide block may have an angled surface and may include a groove on the angled surface to provide clearance for the firearm. The slide block may further include a lock bar received in the slide block and extending through and perpendicular to the barrel port.

The slide shield may have alternate mounting holes to facilitate use of the slide shield by both left-handed and right-handed users.

The locking assembly may further include a magazine storage assembly having a slot for facilitating removal of the cartridge magazine from the magazine storage assembly and a drain hole for draining moisture from the magazine storage assembly. The magazine storage assembly is preferably configured to assume that cartridges are oriented in the proper direction when a spare magazine is withdrawn from the magazine storage assembly for insertion into the firearm.

The action locking arm may be secured to the slide shield by a bolt with a customized head, and the locking assembly may further include a dowel extending between the action locking arm and the slide shield to prevent relative rotation of the action locking arm. The action locking arm may include an ejector bypass and a firing pin bypass. The slide shield may have a groove on the slide shield to provide clearance for a slide lock on the firearm. The slide shield may also include a sight slot.

The slide block may be integral with the slide shield.

Further details and advantages of the invention may be seen from the following detailed description, in conjunction with the accompanying drawings, wherein like reference numerals represent like parts.

DETAILED DESCRIPTION OF THE PREFERRED EMBODIMENTS

Figure 1:
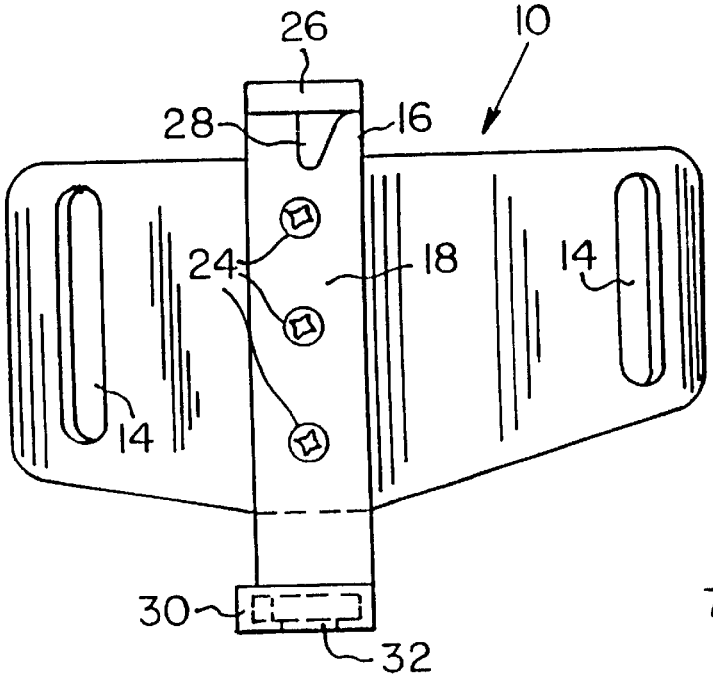
FIG. 1 is a front elevation view of a locking assembly according to a first embodiment of the present invention.
Figure 2:
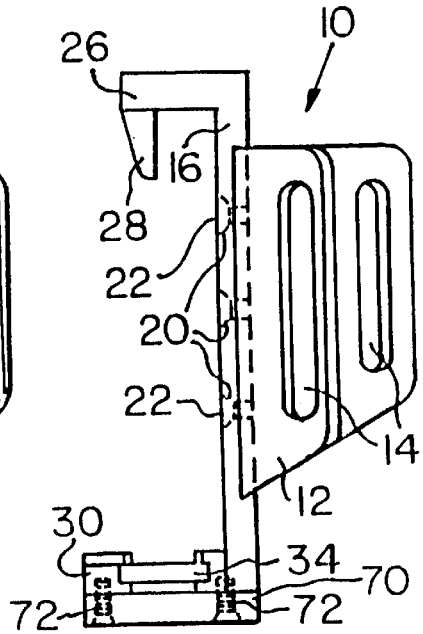
FIG. 2 is a side elevation view of a locking assembly according to the present invention, further including a lock bar.

Referring to FIGS. 1 and 2, the holster 10 of the present invention is made of two sections of aircraft high-strength aluminum, ZYTEL, DENDRIL, or other similar high-strength plastic composite. Materials which will not damage a pistol yet provide requisite strength and durability under extreme conditions of weather or force are expected to be appropriate for use in the present invention. A body plate 12 is designed to contour around the wearer's hip or torso, with openings 14 to accommodate a belt for wearing. An action locking assembly 16 extends transversely across the body plate 12 and is exactly dimensioned for the specific pistol to be secured. The action locking assembly 16 includes a flat support member 18 which includes countersunk holes 20 to receive bolts 22. The action locking assembly is removably secured in a vertical position to the body plate 12 by bolts 22. The bolts 22 are uniquely designed and customized for each individual holster so they may only be removed by a custom tool. For instance, the bolts 22 may include a star design 24, as shown in FIG. 1. The action locking assembly 16 also includes an action locking arm 26 extending from a first upper end of the support member 18. The action locking arm carries an action locking lug 28, which is finger-shaped and extends downward from arm 26, generally parallel to support member 18 and perpendicular to arm 26.

A retainer arm 30 extends from a second lower end of support member 18. The retainer arm may include a barrel port 32 having a contoured or beveled rim 34, as described in further detail below. The body plate 12 can be used as a standard fitting fixed to specifically dimensioned action locking assemblies 16, which may be customized to accept specific weapons and can be designed for either right- or left-handed personnel and straight- or cross-draw mode. One user can purchase multiple action locking assemblies to accommodate his or her various weapons.

Figure 3:
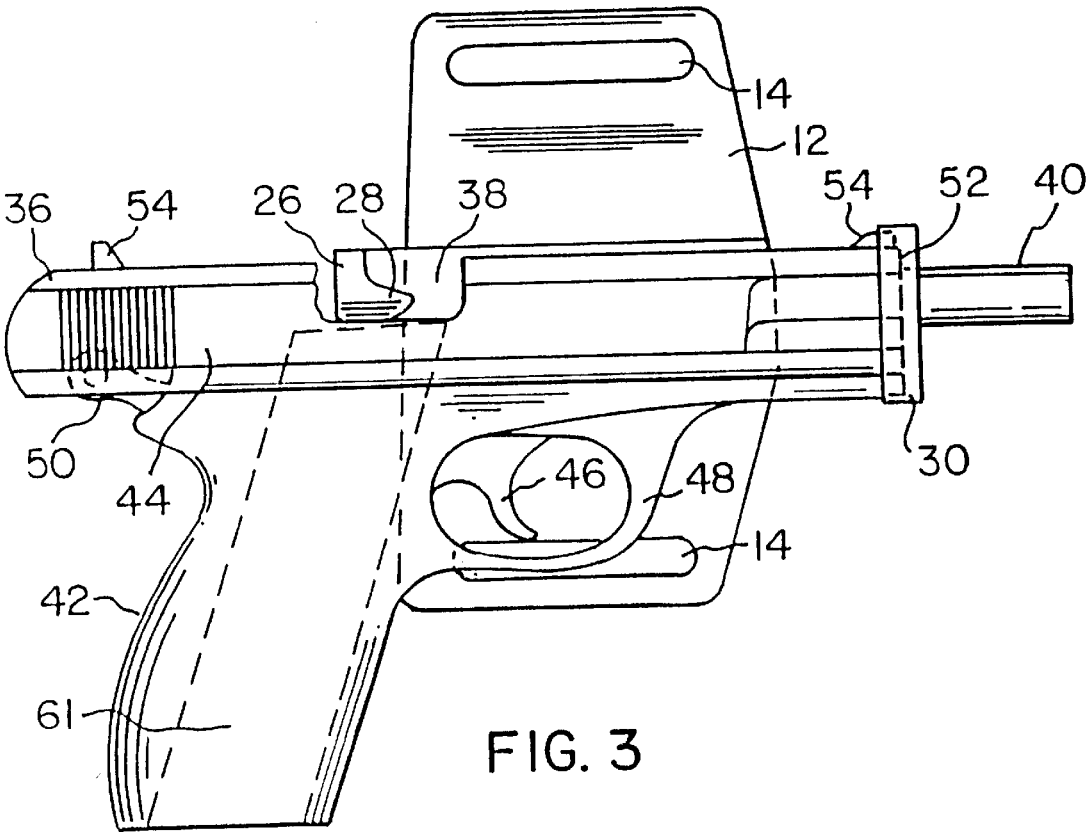
FIG. 3 is a front view of a closed bolt semiautomatic pistol, partially broken away, with the bolt in a fully open position to facilitate securing the pistol in the locking assembly of the present invention.

FIG. 3 depicts a double- or single-action closed bolt semiautomatic pistol 36 for mounting on the holster 10 of the present invention. Pistol 36 is shown with the bolt completely open to expose the firing chamber 38. There is no ammunition cartridge shown in the firing chamber or in battery. The pistol includes a barrel 40, a grip 42, and a spring-loaded, reciprocating slide element 44. The phrase "in battery" is meant to describe the condition where a cartridge is placed in the barrel 40 and is ready to be struck by the firing pin (not shown) for discharge. A trigger 46 with a trigger guard 48 and a hammer 50 are also shown. A muzzle 52 is located at the firing end of the pistol. The pistol also includes sights 54. The slide element 44 includes an ejection port 56, which is basically a cutout in the top and side portions of the sliding element to expose the firing chamber 38.

Ejection port 56 opens toward the left, as the pistol 36 is pointed forward. The size and location of the ejection port, chamber and barrel varies from one model of pistol to another. Some ejection ports may open to the left, some to the right and some directly upward. Therefore, the size and configuration of the action arm 26 and lug 28 will have to be designed according to the particular firearm or class of firearms to be used with the holster 10. Upon reading the instant specification, those of ordinary skill in the art will be able to custom design the action locking arm 26 and lug 28, and in some cases the size and contouring of the retainer arm 30, to achieve the present invention without undue experimentation.

Figure 4:
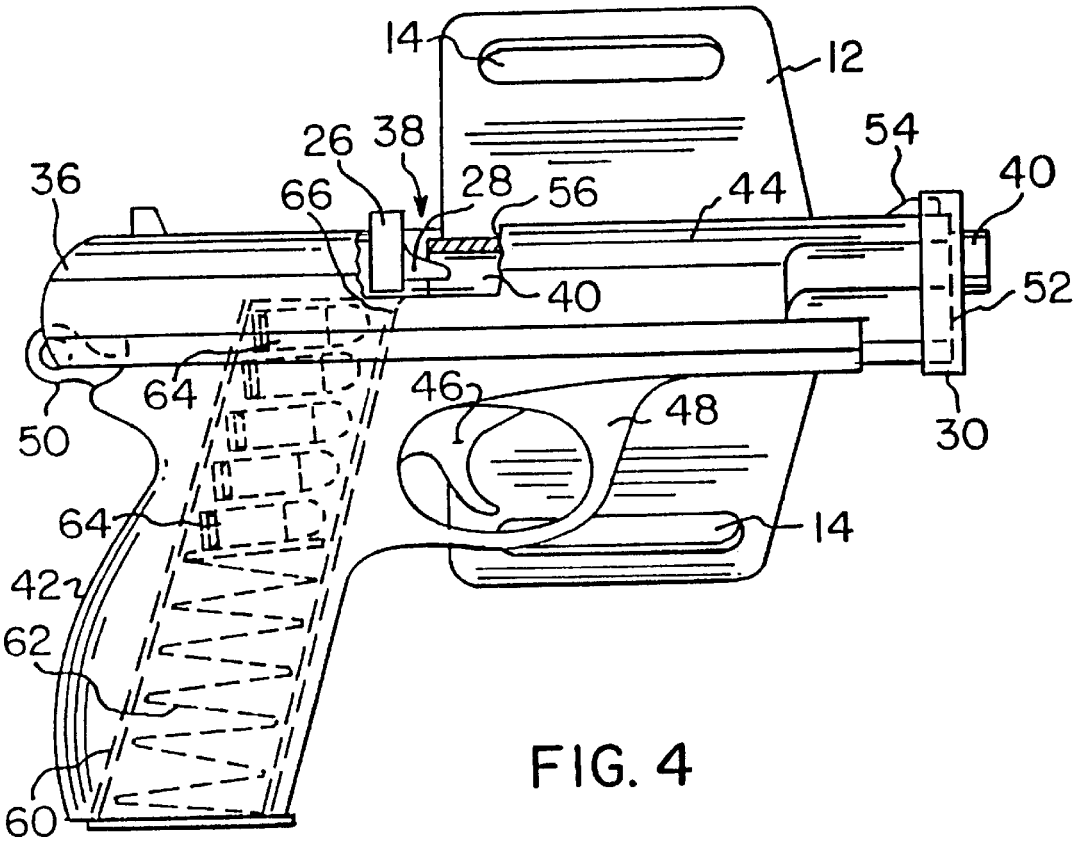
FIG. 4 is a front view of the pistol of FIG. 3 in its locked, secured position in the locking assembly of the present invention, and further showing a magazine with ammunition cartridges in the pistol.
Figure 5:
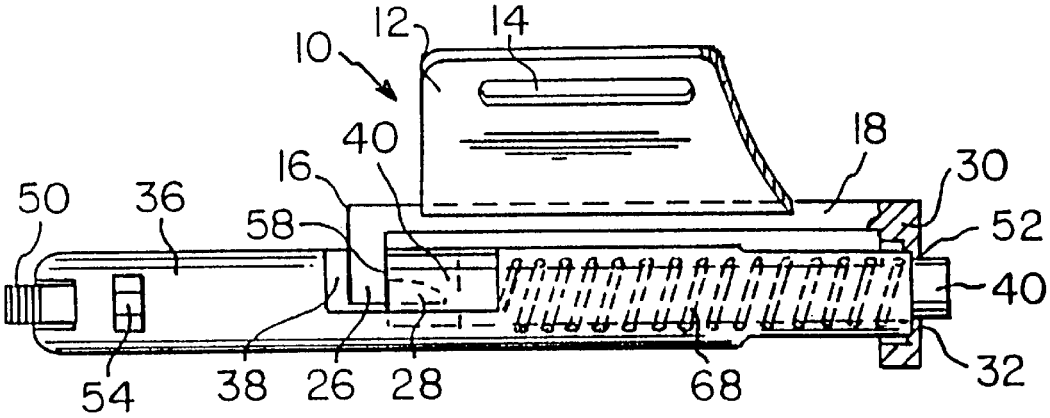
FIG. 5 is a top view of the pistol and locking assembly of FIG. 4.

As shown in FIG. 4, the barrel also includes a barrel face 58, and a magazine 60 may be loaded in a magazine well 61 in the grip 42 for feeding cartridges 64 to the firing chamber 38. Particularly, the magazine has a magazine spring 62 for feeding cartridges 64 to the firing chamber 38 via a feed ramp 66. As shown in FIG. 5, the slide element and the barrel are interconnected by a main recoil spring 68 which provides for a spring action sliding motion between the barrel 40 and the slide element 44.

In order to fully understand the invention, a brief description of the operation of the pistol 36 is in order. In the case of a single-action pistol, the trigger 46 will not function unless the hammer 50 is to the rearward (cocked) position. This position is shown in FIG. 3. The cocked position is established by either pulling the hammer 50 to the rear with the thumb of the hand not holding the pistol 36 or by racking the slide element 44 to the rear. FIG. 3 shows slide element 44 racked to its utmost rearward position. Racking the slide element will set the hammer into the cocked position. When the slide element 44 is pulled to its most rearward position, an extractor and an ejector (not shown) are designed to extract and eject any chambered cartridge from the pistol 36 via ejection port 56. The reciprocating movement of the slide element 44 forward would then load another cartridge 64, under the combined action of the magazine spring 62 and feed ramp 66, into chamber 38 and in battery in barrel face 58.

When the slide element 44 is racked rearward, the barrel 40 remains relatively stationary and thus extends from muzzle 52 a proportionate distance beyond slide element 44. The same occurs if the grip 42 and barrel 40 are pushed forward and the slide element 44 is made to remain stationary. In either case, the recoil spring 68 of the firearm causes the slide element 44 and barrel 40 to return to their normal position, i.e., with the firing end of barrel 40 coterminous with muzzle 52.

To secure the pistol 36 in holster 10, the magazine 60 and any cartridges 64 in chamber 38 are first removed from magazine well 61. The muzzle end 52 of pistol 36 is then placed on the retainer arm 30. Pressing with a slow, firm downward motion with the right-hand (for right-handed personnel) on the grip 42 of the pistol 36, the chamber 38 is opened sufficiently to accommodate the finger-shaped lug 28 through ejection port 56 into chamber 38. This arrangement is shown in FIG. 3. The firm downward pressure on the grip of pistol 36 exerts pressure on the recoil spring 68, adding compressive force to the spring. The pistol 36 is tilted slightly inward (toward body plate 12) so that the lug 28 is aligned with the barrel face 58. Referring to FIG. 4, upon easing the downward pressure on grip 42, the barrel returns upward by the compressive action of the recoil spring and the lug 28 is received in the barrel 40 at barrel face 58, while the action locking arm 26 is positioned in chamber 38, directly above the magazine well 61. The lug 28 is precisely configured to fit within the firing chamber and barrel face of the particular weapon to be used with the holster. The length of the lug 28 should be such that the lug may be placed in the chamber and fitted into the barrel 40 when the slide element 44 has moved to place chamber 38 in the half-open position. The lug 28 cannot be removed by any forward, backward, upward or lateral movement of the pistol 36 once the lug is positioned in barrel 40 and the downward pressure on grip 42 is released. The presence of the action locking arm 26 in chamber 38 prevents operation of trigger 46.

Release of pressure on the grip 42 allows the recoil spring 68 to expand to approximately half of its originally compressed state, and chamber 38 is closed to within the thickness of the action locking arm 26. As the force of the recoil spring 68 is exerting equal pressure on either end of the spring, the muzzle is firmly locked within the precisely contoured levels of the retainer arm 30. Retainer arm can be exactly contoured or indented to accept the specific muzzle of the pistol being used with the holster. The retainer arm may also be horseshoe-shaped with an open end, if the muzzle of the particular pistol requires, for ease of removal. The lug 28 is at the same time firmly held within barrel 40 by the force of the recoil spring 68. The pistol is thus rigidly and safely held within the equally pressured pincers of the retainer arm 30 and the action locking arm 26 and lug 28 at opposite ends of the action locking assembly 16. Thus positioned, the pistol 36 cannot be removed from the holster 10 by normal upward motion, as is the case with conventional holsters. If an unauthorized attempt is made to withdraw the pistol from the holster by the normal upward motion, this attempt will be defeated because it is counteracted by the strength and rigid positioning of the lug 28 and action locking arm 26 within the barrel 40 and chamber 38, respectively.

After the pistol 36 is positioned in the action locking assembly, the wearer places a loaded magazine 60 into the magazine well 61. As the chamber 38 has been closed and locked by the action locking arm 26 and lug 28, no cartridges 64 can be placed within the chamber 38 itself as the action locking arm 26 is directly above the path of the cartridges 64. The only way to chamber a cartridge 64 into battery is to remove the obstructing action locking arm 26 and lug 28. Thus holstered, a pistol 36 can now be carried safely without a chambered cartridge 64. The specifically contoured levels of the retainer arm 30 stabilize the pistol 36 from any forward, backward, upward, downward or lateral movement.

To deploy the pistol, controlled speed is of primary importance. By a one-handed swift downward motion on the grip 42 of pistol 36, the chamber 38 is opened. Particularly, the downward pressure on grip 42 forces barrel 40 downward through the specifically designed barrel port 32 in retainer arm 30. The muzzle end of the slide element 44 is retained against downward motion by the retainer arm 30. With the chamber 38 open and barrel face 58 moved downward, the action locking arm 26 and lug 28 may now be removed from chamber 38. The arm 26 and lug 28 are removed from chamber 38 with a slight tilting motion of the pistol 36 from the longitudinal axis of the action locking assembly 16, after the grip 42 and barrel 40 have been forced to the maximum downward position. At the same time, the hammer 50 is cocked by virtue of its contact with slide element 44. The previously restricted cartridge 64 in magazine 40 is now free to proceed, under the force of magazine spring 62, up feed ramp 66 into chamber 38. The forward motion of slide element 44 places the cartridge 64 in battery in barrel face 58. Thus, with the use of only one hand, the pistol 36 is now safely out of holster 10, with the cartridge 64 chambered in battery, cocked, ready to fire. A manual safety lever (not shown) on the pistol 36 may be employed by the user if the crisis requiring withdrawal of the pistol has eased.

When the crisis has abated, the chambered cartridge 64 is removed from chamber 38, and the magazine 60 is removed from grip 42. The pistol 36 is then placed into the holster 10, as described above. Once positioned in the holster 10, the pistol's magazine is placed back into grip 42. Again, there is no cartridge 64 chambered in battery.

To simply remove the pistol from the holster for storage, the magazine 60 is first removed from grip 42, thus assuring that no cartridges could enter the chamber 38 as they are all within the magazine 60. With the magazine set aside, the pistol can be removed from the holster as described above. The compressive force of spring 68 will then close the chamber 38, and the pistol 36 is thus in an unloaded and safe condition.

In passive, nonthreatening situations, the user may choose to carry the pistol 36 in holster 10 without the magazine 60. With conventional holsters, one must withdraw the pistol, work the action to extract and eject a chambered round and, after retrieving the unfired, ejected round, cleaning it and reloading it within the magazine, reholster the pistol. This situation is quite dangerous if one forgets that a round is in battery and merely removes the magazine, creating a hazardous condition. With the invention, the wearer may remove the magazine 60 from the pistol 36 without removing it from the holster 10. The magazine may be removed by pressing the appropriate release button on grip 42 (not shown) and pocketing the fully loaded magazine. The presence of locking arm 26 and lug 28 in chamber 38 ensures there is no cartridge 64 in battery. Rearming the weapon is easily accomplished by inserting the magazine within the grip with one hand.

Unlike the use of conventional holsters when used for storage, where one must rely on memory as to whether or not the weapon was stored with a loaded magazine or a cartridge in battery, storing a weapon locked within the invention assures no rounds are chambered, regardless of the status of the magazine.

The invention has an additional unique action locking safety device, one type for closed bolt, semiautomatic pistols and the other for open bolt, fully automatic machine pistols. For the closed bolt semiautomatic pistols, such as pistol 36, the holster 10 is provided with a specifically designed lock bar 70, as shown in FIG. 2. As described above in connection with support member 18, the lock bar 70 may be uniquely designed with a countersunk star bolt 72, requiring a custom tool (not shown). The tool and bolt may be serialized for each holster so that each is unique to the given holster. The lock bar 70 is positioned on a lower portion of retainer arm 30 after the pistol 36 has been secured in the holster. Thus positioned, the lock bar 70 prevents barrel 40 from extending through the barrel port 32. As described above, this motion of the barrel is necessary to provide clearance for removal of lug 28 from the barrel face 58. When the barrel 40 is restricted, the lug remains in the barrel face and the pistol 36 may not be removed from the action locking assembly 16. With the lock bar 70 installed, it is virtually impossible to remove the pistol 36 from the holster 10 without having the specific tool designed to be used in connection with the custom star bolts 72.

The holster 10 of the present invention may also be used with open bolt automatic machine pistols, such as the machine pistol shown and described in U.S. Pat. No. 4,579,037 referred to herein as the "CHAMP" pistol ("CHAMP" is an acronym for "controllable hand-held automatic machine pistol"). The CHAMP pistol 78 is shown in use with the holster 10 in FIGS. 6 and 7. The CHAMP pistol includes a bolt 80 and a shroud 82 with a recoil spring 84 and a barrel 86. A grip 88 with a magazine release 90 is adjacent a trigger 92 and trigger guard 94. The trigger guard includes a safety flap 96 which pivots with respect to the longitudinal plane of the CHAMP pistol 78 and is biased by spring 98. A chamber 100 is defined between bolt 80 and barrel face 102. In the embodiment shown in FIGS. 6 and 7, the chamber 100 is open toward the left as one holds the pistol 78 pointed forward. The action arm 26 and lug 28 thus fit directly into the chamber 100 when the pistol is carried on the right-hand waist of the holster wearer. Further details respecting the CHAMP pistol may be seen in U.S. Pat. No. 4,579,037, incorporated herein by reference.

When cocked, the bolt 80 of the CHAMP pistol 78 is placed at the rear of the weapon, with the first cartridge 64 aligned immediately in front of the bolt 80. Pressing the trigger will cause the bolt 80 to rapidly move forward, picking up the cartridge and placing it into the barrel face 102 (in battery) and instantaneously striking the primer to fire the round. The counterforce of the exploding round forces the bolt to the rear, opening the chamber 100 to expel the spent cartridge out of the ejection port (not shown). The CHAMP machine pistol 78 will keep functioning in this manner as long as pressure is maintained on trigger 92 or until all ammunition is expended. It is imperative that machine pistols be carried and deployed under conditions of utmost safety so as to protect users and bystanders. The invention can be made to accommodate virtually any well-known machine pistol, micro-submachine gun, etc., such as the mini-uzi, Cobray M-11, MAC-10, H&K MP-5K, Beretta, FN or Steyhr submachine guns or machine pistols.

Figure 6:
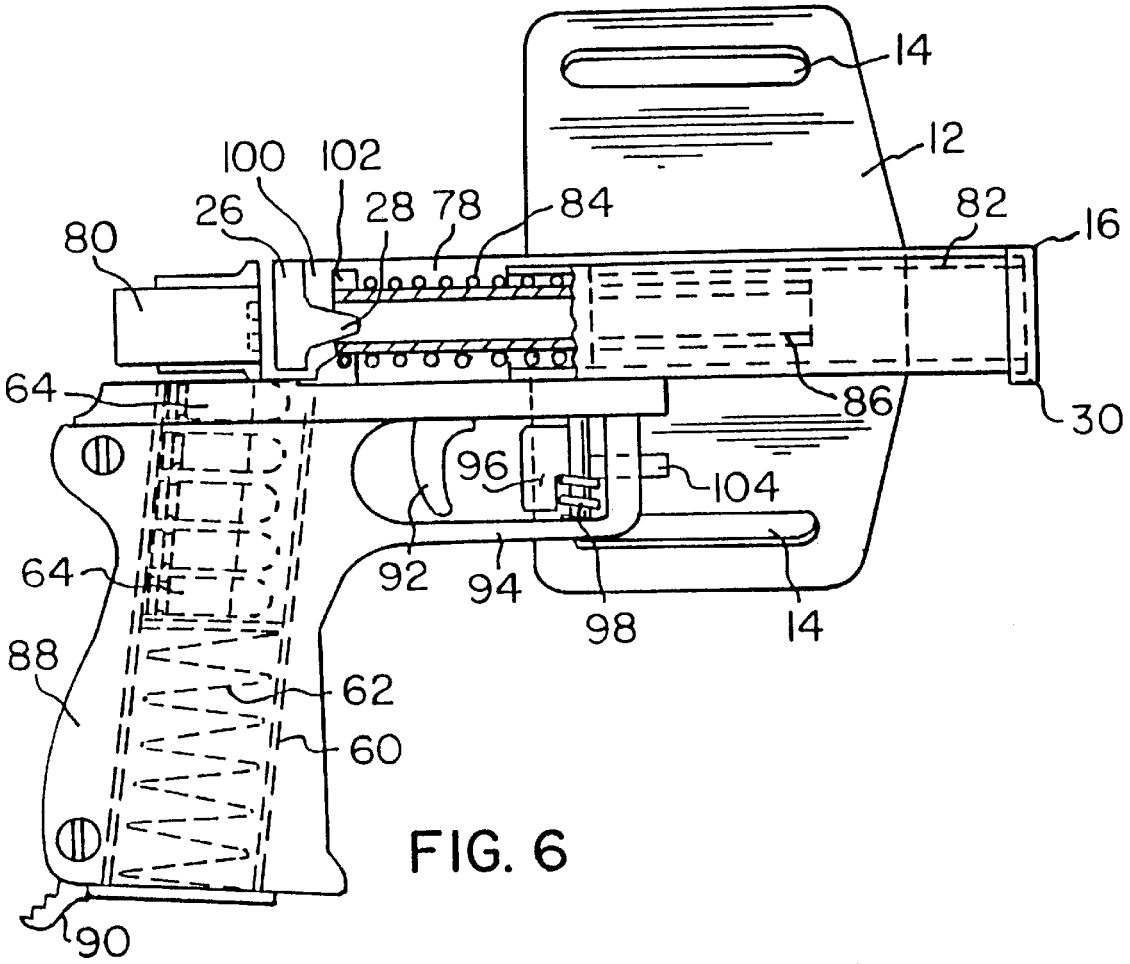
FIG. 6 is a front view of an open bolt fully automatic machine pistol, partially broken away and in partial cross-section, secured in a locking assembly and holster according to the first embodiment of the present invention.
Figure 7:
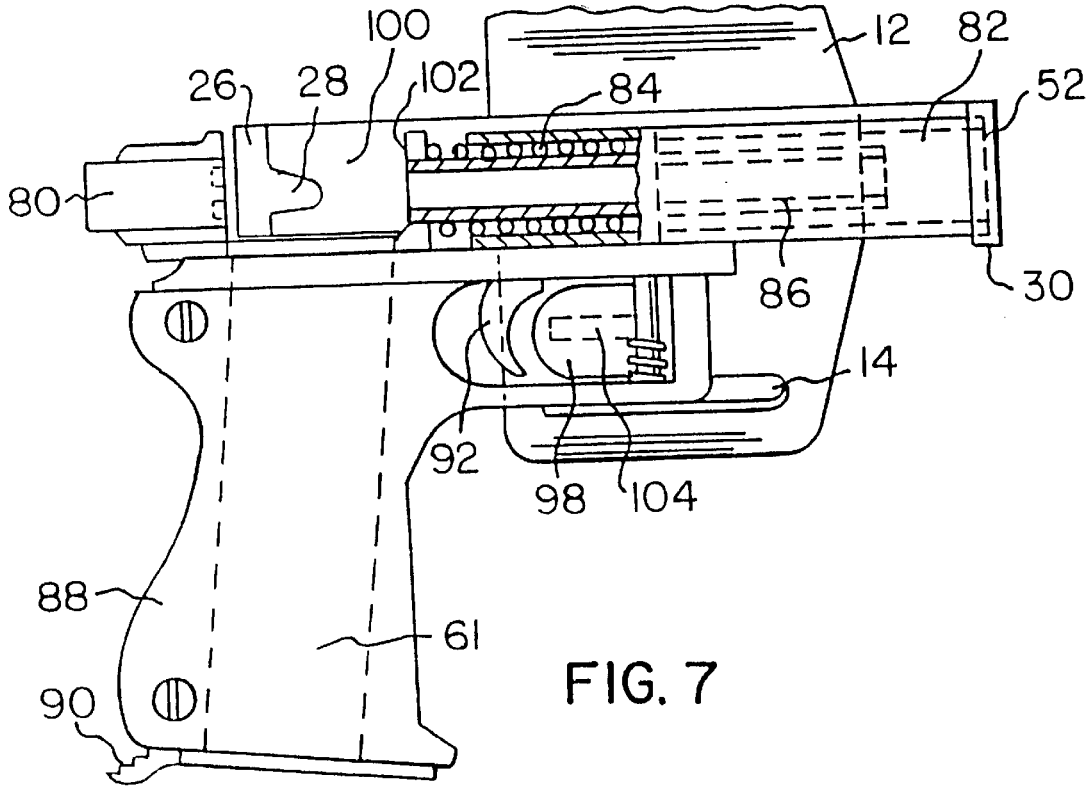
FIG. 7 is a front view of the pistol and locking assembly of FIG. 6, partially broken away and in partial cross-section, wherein the pistol grip is pressed downward so that the pistol may be deployed from the locking assembly.

As was the case with the semiautomatic pistol described above, the CHAMP 78 is positioned in the holster only after the magazine 60 is removed from grip 88. To mount the pistol 78 in holster 10, the user presses downward on grip 88 to open chamber 100 so that lug 28 and arm 26 may be received therein. The open chamber position is shown in FIG. 7. Once the lug is aligned with barrel face 102, the user presses trigger 92 and releases pressure on the grip, allowing the recoil spring 84 to carry the barrel up toward the lug so that the lug 28 is received in the barrel face 102, as shown in FIG. 6. The bolt also moves toward arm 26, when the trigger is pressed, so that the arm 26 and lug 28 are sandwiched between the bolt 80 and barrel face 102, as shown in FIG. 6.

If a cartridge were within the barrel face of the firing chamber, the action locking lug 28 would be restricted from entry therein, thereby indicating to the user that the breech must be cleared before the weapon can be holstered. The action locking lug 28 should be specifically designed to be blunt-ended or off-center from the plane of the firing pin on bolt 80 and the primer of the cartridge 64. This ensures that it is virtually impossible for the action locking lug 28 to involuntarily fire a round by contacting the primer. With the action locking arm 26 and lug 28 secured within the partially opened chamber 100, the force of the compressed recoil spring 84 generates a strong pincer action between the arm and lug 26, 28 and the retainer arm 30, locking the pistol 78 securely within the holster 10.

Even if a loaded magazine were inadvertently placed within the pistol 78 prior to lockup in holster 10, the bottom surface of bolt 80 and action locking arm 26 would push the uppermost cartridge 64 within the magazine down, out of alignment with the normal cartridge path to chamber 100, thus restricting the cartridge from entering the barrel face 102.

Deployment of the pistol 78 is the same as described above in connection with pistol 36.

The holster may also be provided with an automatic trigger safety activating ramp 104, specifically designed for the CHAMP pistol. Particularly, the trigger safety flap 96 remains out of line with the trigger 92, until the user exerts pressure downward on grip 88 to remove the pistol 78 from the holster 10. The downward movement of the pistol causes the trigger safety flap 96 to engage the inclined safety ramp 104, positioned on the body plate 12 in the appropriate location. The trigger safety flap thus rotates approximately 60° around the spring bias 98 so that access to the trigger 92 is blocked by the safety flap 96. Therefore, in order to fire the first round of the pistol 78, the user's finger must push the trigger safety flap 96 to its open position.

When reholstering the pistol 78, the magazine is removed from the pistol, the chamber 100 is cleared and the action locking arm 26 and lug 28 are positioned into the chamber 100, as discussed above.

Figure 8:
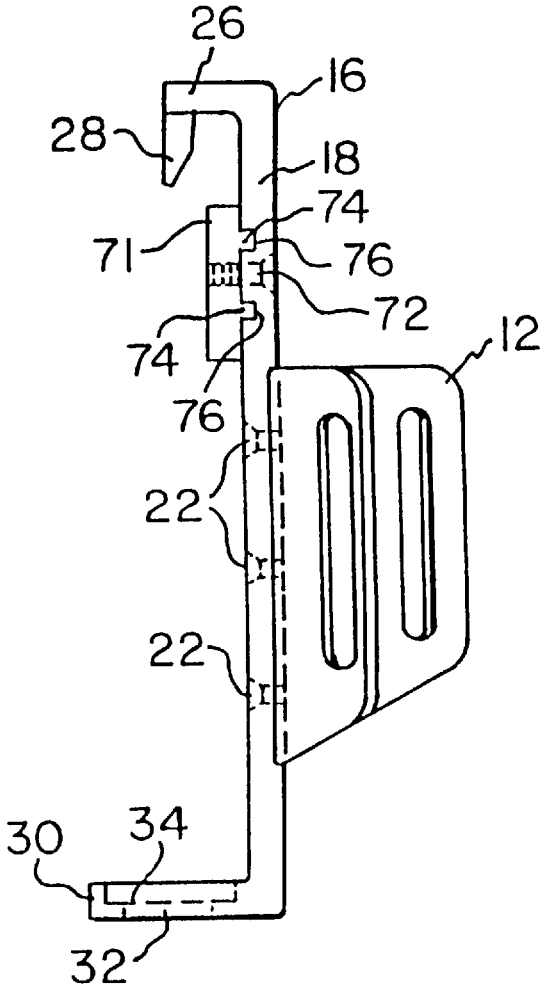
FIG. 8 is a side elevation view of a locking assembly according to the present invention, including an alternative lock bar arrangement.
Figure 9:
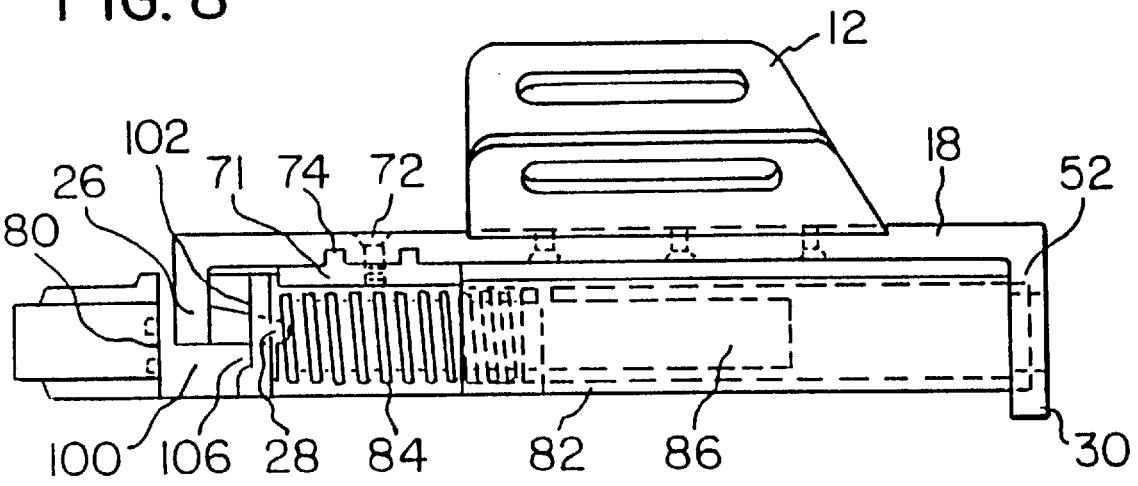
FIG. 9 is a top view of the pistol and locking assembly of FIG. 6, showing a lock bar positioned adjacent the pistol's firing chamber.
Figure 10:
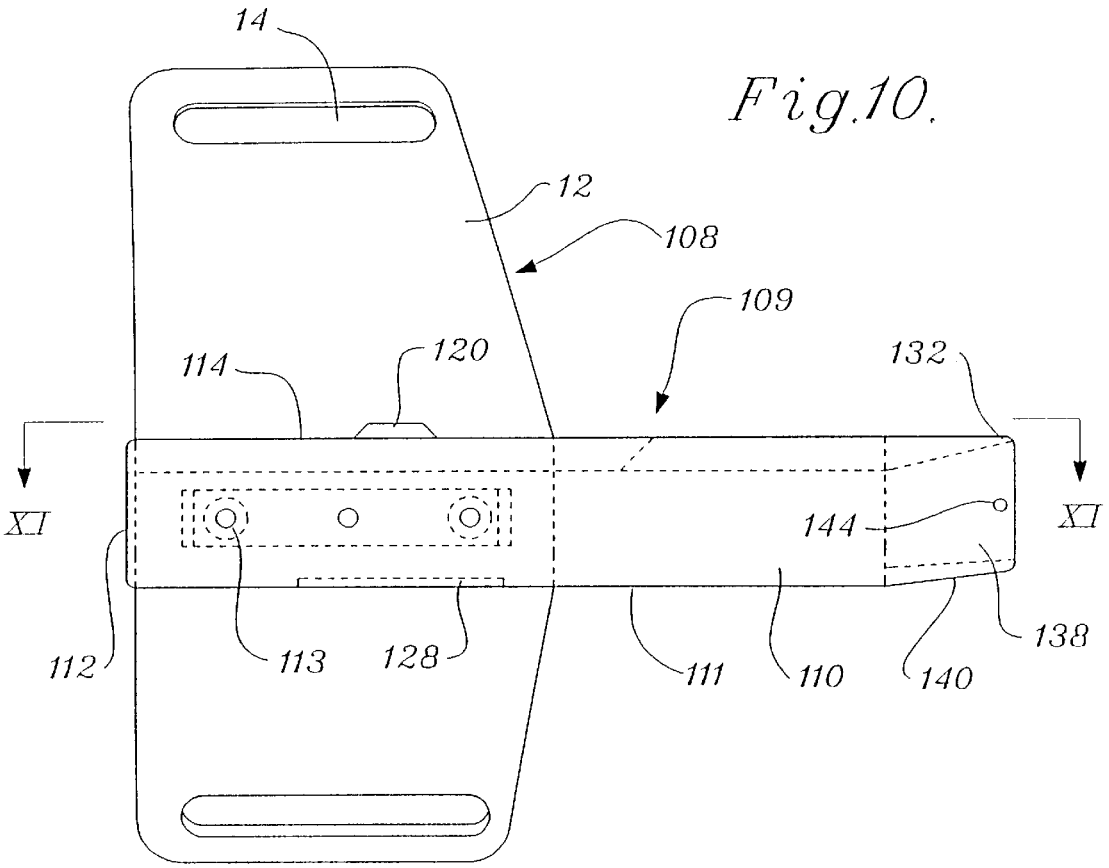
FIG. 10 is a side elevation view of a locking assembly, on a body plate, according to a second embodiment of the present invention.
Figure 11:
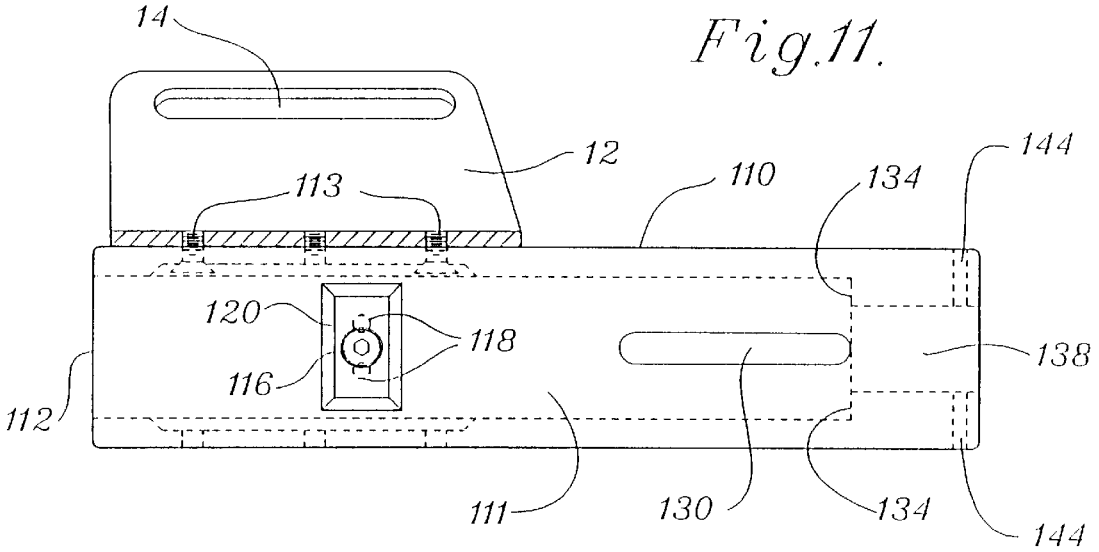
FIG. 11 is a top view, in partial section, of the locking assembly of FIG. 10.
Figure 13:
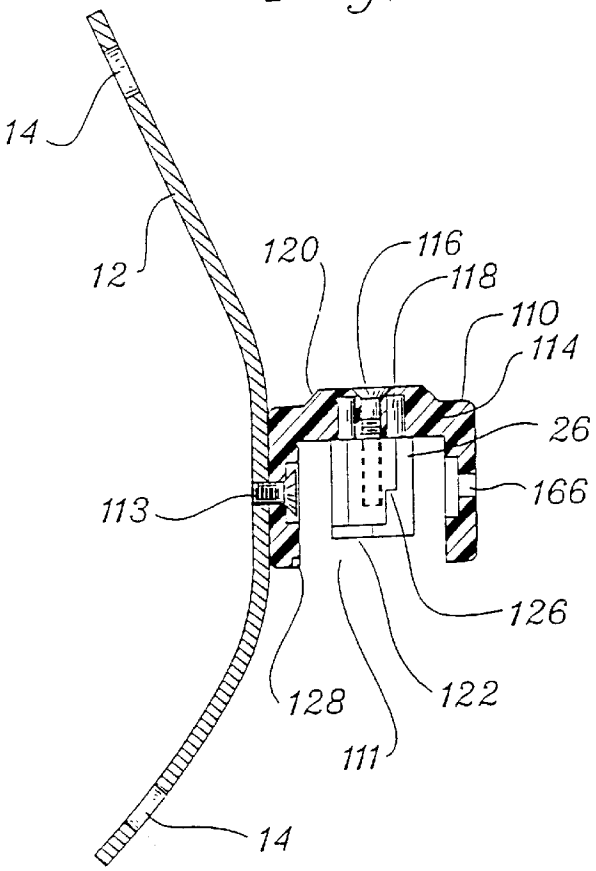
FIG. 13 is a sectional view taken along lines XIII—XIII of FIG. 12.
Figure 12:
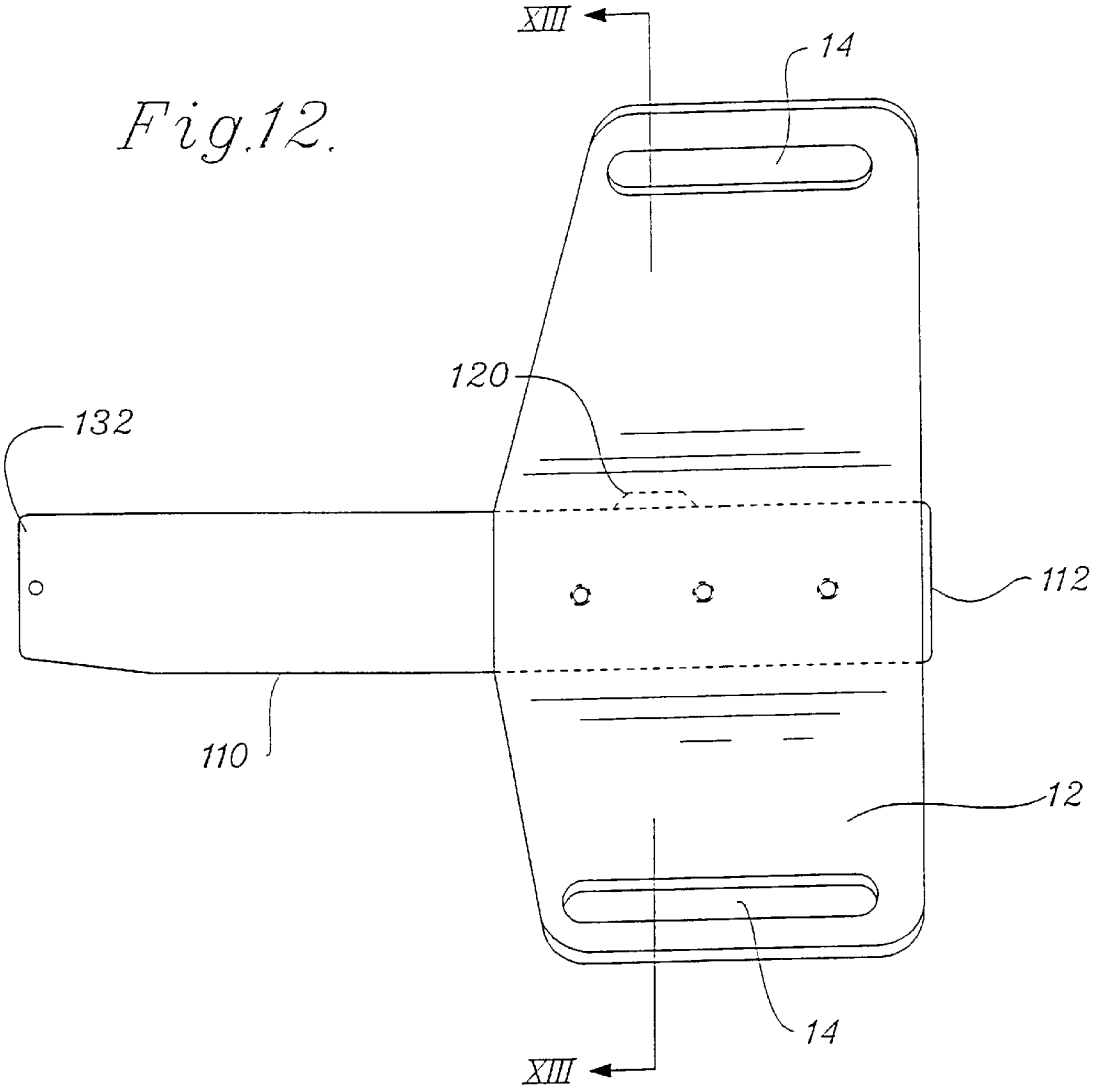
FIG. 12 is a side elevation view of the opposite side of the locking assembly of FIG. 10.
Figure 14:
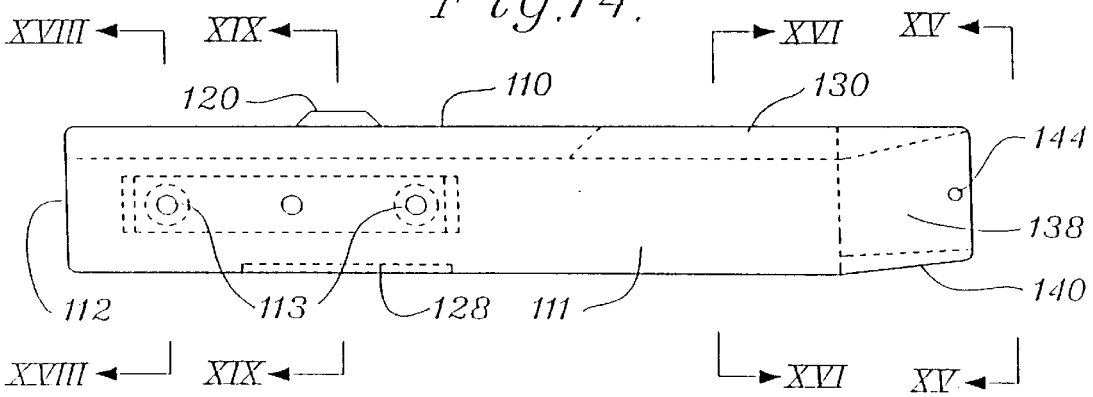
FIG. 14 is a side elevation view of the locking assembly of FIG. 10, excluding the body plate.

Referring to FIGS. 8 and 9, an alternate lock bar assembly is shown for use with open bolt automatic pistols. In this embodiment, lock bar 71 is secured on support member 18 by star bolt 72. Lock bar 71 includes two ribs 74, which are received in grooves 76 on support member 18 to prevent rotation of the lock bar 71 relative to the support member 18. The location and size of the lock bar 71 in this embodiment would be tailored to the weapon to be secured. For pistol 78, the lock bar 71 may be positioned in the action of the weapon, between the shroud 82 and a portion 106 of the pistol adjacent the firing chamber, as shown in FIG. 9. The lock bar 71 engages portion 106 to prevent its movement along the pistol's longitudinal axis when the grip 88 is pressed downward. The chamber 100 cannot then be further opened to permit withdrawal of action locking arm 26 and lug 28, and the weapon is thus totally locked within the holster 10. Pistol 78 may only be removed from holster 10 by first removing the lock bar 71 with a specific tool customized to fit the star bolt 72. The ribs 74 slide within grooves 76 for lifting the lock bar 71 out of the pistol's action.

It is contemplated that, in some applications, it will be desirable to provide a spring-loaded, hinged action locking arm 26 and/or action locking lug 28. For example, the action locking lug 28 may be loaded with a recessed spring. The spring would remain compressed, keeping the lug 28 in alignment with the firearm's barrel when in the holster 10. As downward pressure is applied to the firearm and the firearm is tilted outward, the lug 28 pivots out of the barrel and ejection port, and the spring returns the lug 28 to its proper position.

Referring to FIGS. 10–13 and 21, an additional embodiment of the invention is shown. This embodiment is the current preferred embodiment and best mode of the invention. Holster 108 has a body plate 12, with openings 14, similar to the first embodiment described above. However, holster 108 has a rectangular locking assembly 109 which includes a slide shield 110 (hereinafter "shield 110") mounted to the body plate 12 by bolts 113. Shield 110 has opening 111 on the bottom and first end 112 is also open. The slide element 44 of the pistol 36 is received in the shield 110, as discussed in further detail below. Shield 110 has a sight slot 130 to provide clearance for the forward sight 54 on the holstered pistol. Shield 110 is preferably made of DENDRIL or ZYTEL, high strength plastic composites available from Dow Chemical and other high quality plastic suppliers.

Action locking arm 26 is secured to a top wall 114 of the shield 110 by bolt 116 and dowels 118. Dowels 118 prevent the action locking arm 26 from rotating about the bolt 116 when torqued. Mounting plate 120 allows for removability of the action locking arm 26. It may be desired, for example, to remove arm 26 and replace it with another arm more suitable for a different pistol model to be used with the locking assembly 109. As described above in connection with the first embodiment, bolt 116 preferably may have a unique head design, requiring a custom tool to remove the bolt.

Action locking arm 26 carries action locking lug 28. Action locking arm 26 and lug 28 are configured to fit the chamber configuration of the particular model of closed bolt semiautomatic pistol or open bolt automatic machine pistol for which the locking assembly 109 is to be used. It will be understood by those of ordinary skill in the art that the configuration of action locking arm 26 and lug 28 must be designed to suit particular pistol models for which the locking assembly 109 is to be used. The design essentially depends on the internal configuration of the mechanisms in the chamber of the pistol. It is also important that the configuration of arm 26 prevent chambering of a cartridge from a magazine installed in the pistol.

Figure 21:
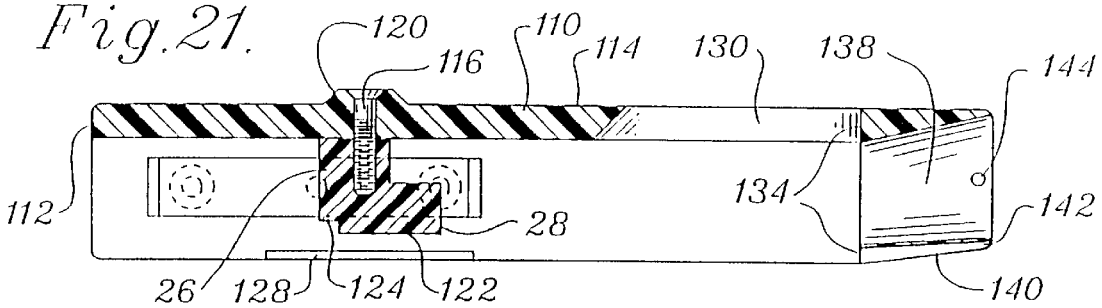
FIG. 21 is a longitudinal sectional view of the locking assembly of FIG. 14.

Referring to FIG. 21, lower end 122 of arm 26 is positioned to prevent a cartridge from the magazine in the handle of the holstered pistol from entering the firing chamber of the pistol when the slide is opened. Action locking arm 26 and lug 28 are received in the firing chamber of the holstered pistol. Notch 124 on arm 26 defines a firing pin bypass and provides clearance for the firing pin on the holstered pistol. Notch 126 defines an ejector bypass and allows the ejector in the holstered pistol to bypass action locking arm 26. Notch 128 is to provide clearance for the slide lock on the holstered pistol. It has been found that the various notches on arm 26 prevent jamming of the pistol 36 within locking assembly 109. Lug 28 is blunt-ended to prevent accidental discharge of the primer on any cartridge in battery within the firearm.

Referring to second end 132, slide shield 110 has an integral slide block 134. Slide block 134 provides a bearing surface and prevents the slide element 44 from moving toward second end 132. Slide block 134 has a barrel port 138 for passage of the muzzle end of the barrel of the pistol therethrough while the slide element 44 remains stationary. Barrel port 138 is preferably oval in cross-section and flares outward so that the maximum diameter of barrel port 138 is at the second end 132 of the shield 110.

The second end 132 of shield 110, at slide block 134, is angled slightly upward at 140 to facilitate insertion of and removal of the pistol from the locking assembly. Angle 140 also includes a milled or molded groove 142 shown in FIGS. 15 and 16. Groove 142 provides clearance for guide rod 152 on the pistol 36.

Figure 15:
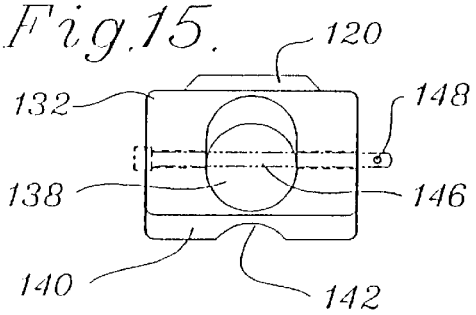
FIG. 15 is a front end view of the locking assembly of FIG. 14, further including a locking pin.
Figure 16:
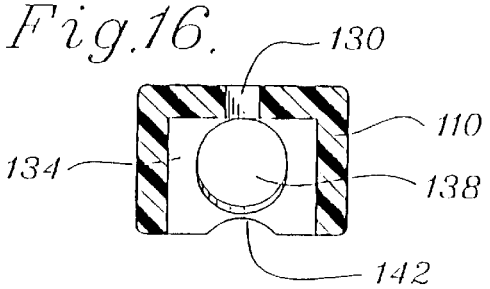
FIG. 16 is a sectional view taken along lines XVI—XVI of FIG. 14.
Figure 17:
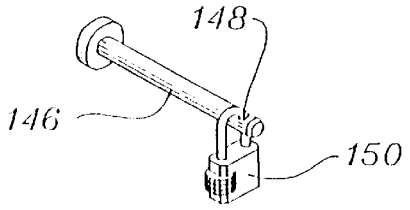
FIG. 17 is a perspective view of a locking pin and lock for use with the present invention.
Figure 18:
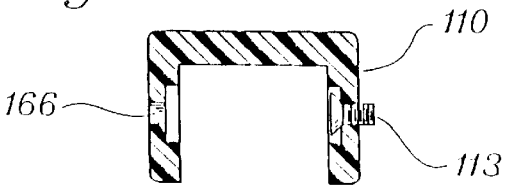
FIG. 18 is a sectional view taken along lines XVIII—XVIII of FIG. 14.
Figure 19:
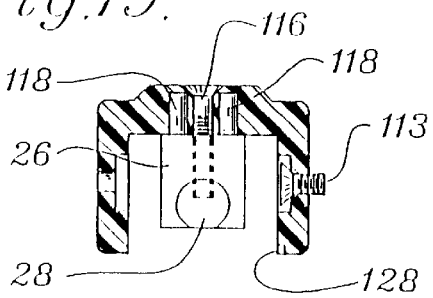
FIG. 19 is a sectional view taken along lines XIX—XIX of FIG. 14.
Figure 20:
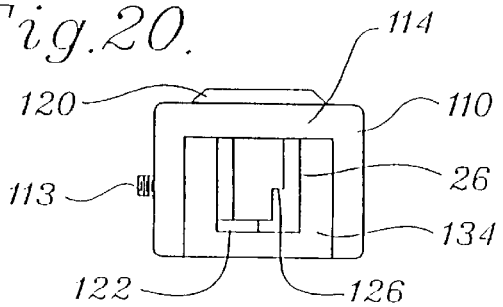
FIG. 20 is a rear end view of the locking assembly of FIG. 14.

Second end 132 of shield 110 has holes 144 for receiving a locking pin 146. Locking pin 146 may include a hole 148 for receiving lock 150, as shown in FIG. 17. Referring to FIG. 15, when locking pin 146 is installed in holes 144, barrel 40 is prevented from passing through barrel port 138. This secures the pistol within shield 110 in a similar manner to lock bar 70 described in connection with the first embodiment, above.

Figure 22:
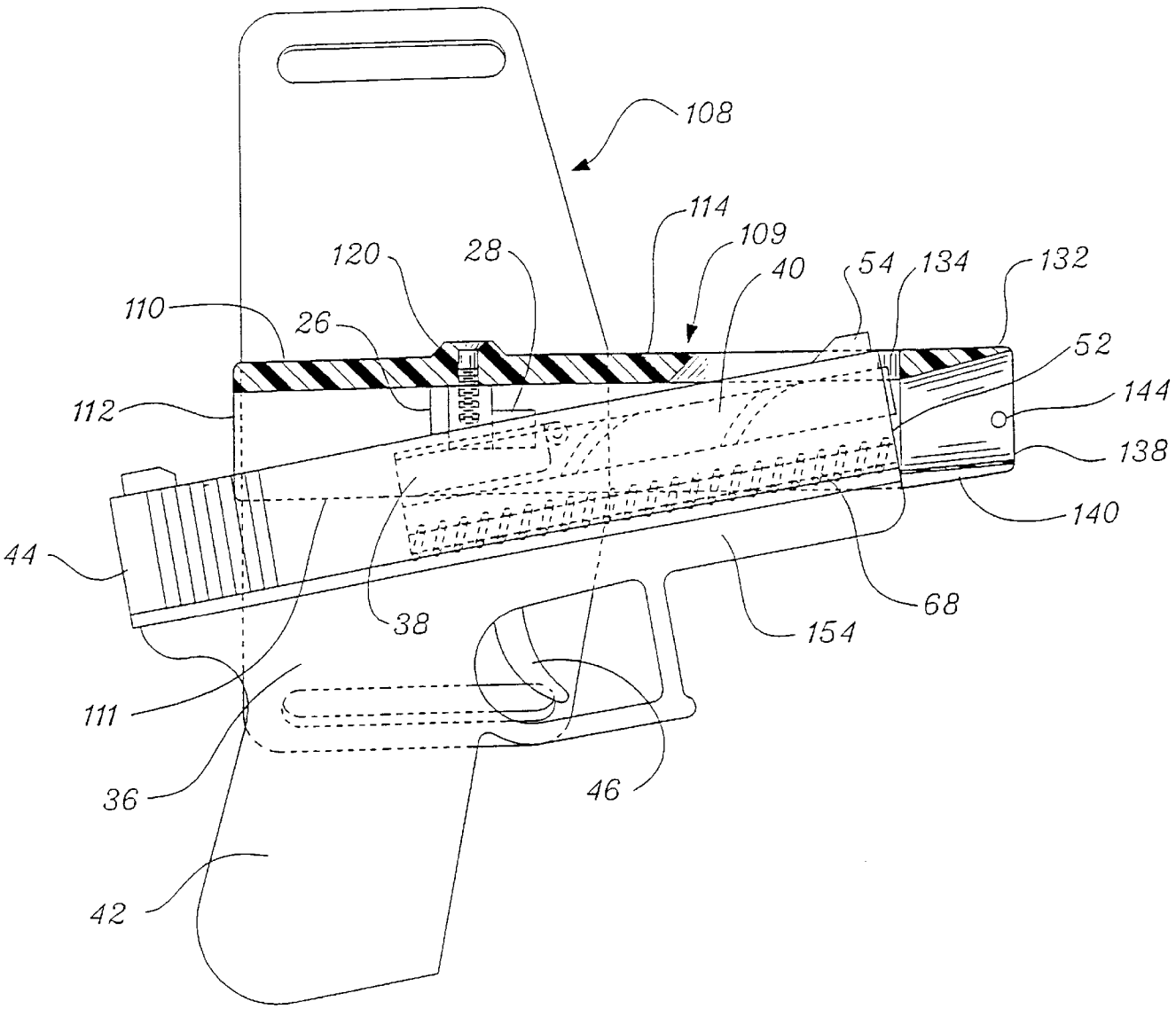
FIG. 22 is a side elevation view, in partial section, showing insertion of a pistol into a locking assembly in accordance with the second embodiment of the present invention.
Figure 23:
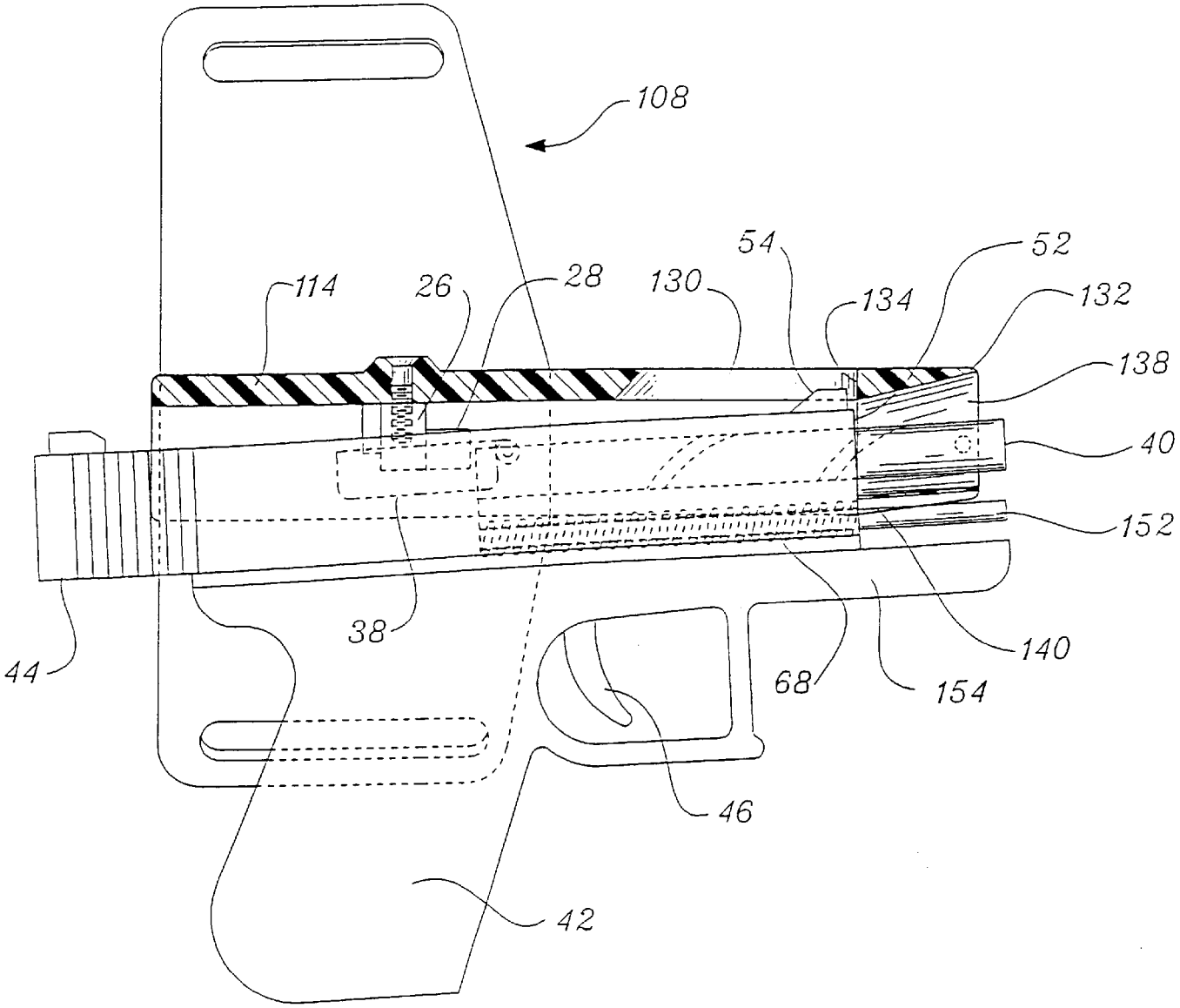
FIG. 23 is a side elevation view of the pistol being inserted in a locking assembly according to the second embodiment of the invention.
Figure 24:
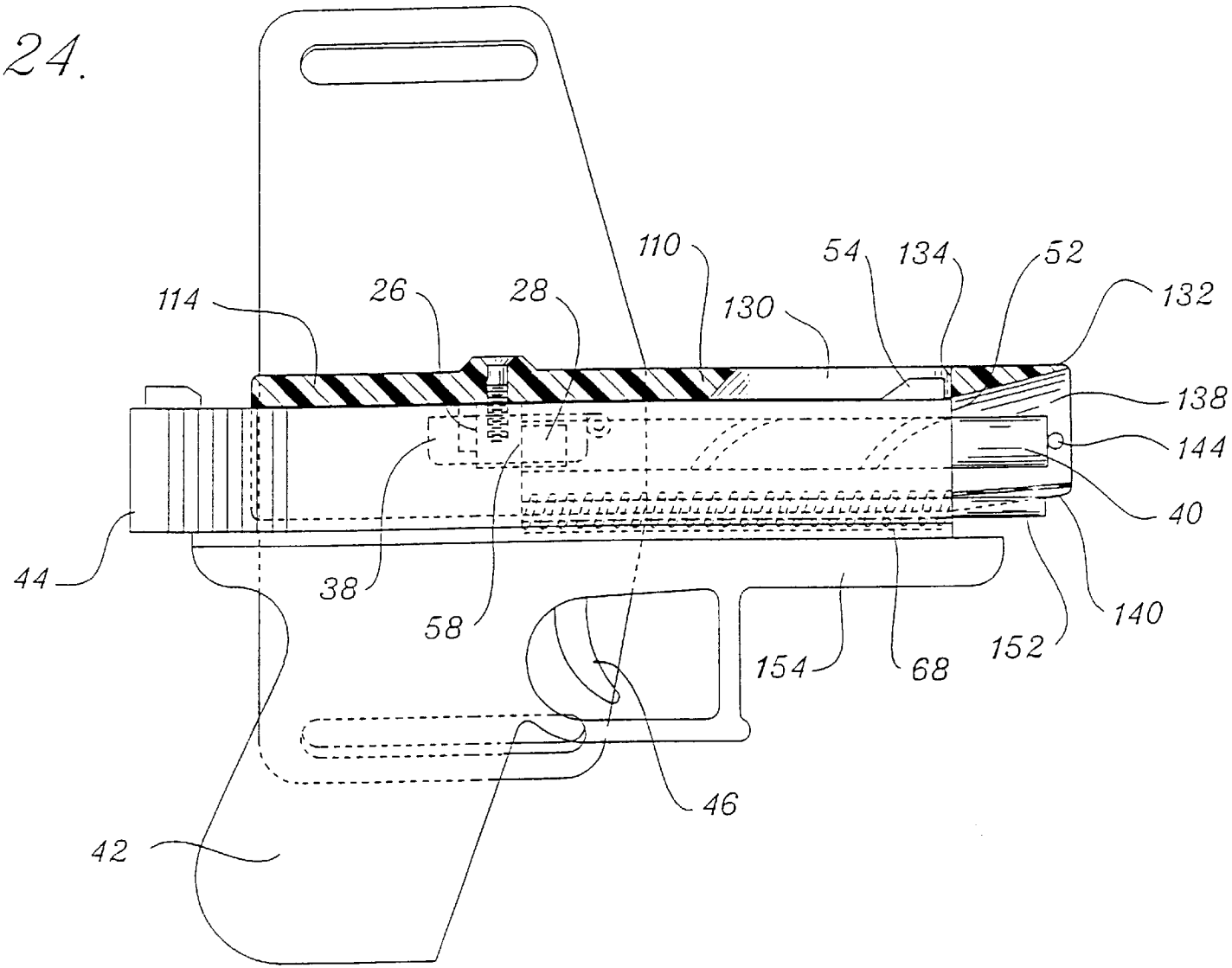
FIG. 24 is a side elevation view of the pistol and locking assembly of FIG. 23 with the pistol fully inserted in the locking assembly.

Referring to FIGS. 22–24, operation of the locking assembly 109, in installing and removing a closed bolt semiautomatic pistol, will now be explained. The slide element 44 on pistol 36 is inserted through opening 111 into the shield 110 at an angle. The muzzle 52 of the pistol is rested against slide block 134. Handle 42 of the pistol 36 is then pressed in the direction of second end 132 of shield 110, and barrel 40 thus extends through barrel port 138, as shown in FIG. 23. Firing chamber 38 opens correspondingly to the length of the barrel received in barrel port 138. Action locking arm 26 and lug 28 are received in firing chamber 38 of the pistol 36, as the pistol is tilted toward top wall 114 of shield 110.

As the handle 42 of the pistol 36 is being pushed toward second end 132, guide rod 152 on the pistol 36 passes through groove 142 on the angled portion 140 of the shield. Angled portion 140 provides clearance for the frame 154 of the pistol 36. Depression of grip 42 toward second end 132 on the shield compresses recoil spring 68 in pistol 36, as described in connection with the first embodiment above.

The angled portion 140 on the slide shield 110 acts as a positive guide directing the front of the frame 154 of the pistol 36 to slide in an unobstructed manner under the front of the slide shield 110. At the same time, the slide shield 44 of the pistol 36 is restricted from moving by the slide block 134. Barrel 40 exits through barrel port 138 while guide rod 152 passes through groove 142. The firing chamber 38 opens in equal measure to the movement of the barrel 40, grip 42 and frame 154.

Referring to FIG. 24, after the pistol 36 is tilted in contact with top wall 114 on shield 110, pressure on grip 42 is removed and the recoil spring 68 returns to a less compressed state. The recoil spring 68 thereby causes the barrel 40 to retract in shield 110 until barrel face 58 receives action locking lug 28 and engages action locking arm 26. Barrel 40 is then housed within barrel port 138, and the barrel and slide are substantially protected within shield 110. The muzzle end of slide element 44 engages slide block 134, and barrel face 58 engages action locking arm 26 and lug 28. The forces provided by the partially compressed spring 68 thus keep the pistol secured within locking assembly 109.

The bottom 122 of action locking arm 26 also functions as a cartridge entry block similar to the arrangement shown and described in FIG. 4, above. Bottom 122 is in contact with the top surface of the barrel 40 at its most rearward position, when the firing chamber is completely closed and locked. As the pistol 36 is further pushed into the holster, the firing chamber 38 opens completely as the slide element 44 is restricted by slide block 134 and barrel 40 extends through barrel port 138. With the firing chamber 38 fully opened, recoil spring 68 bears force on the slide block 134. Action locking arm 26 and lug 28 are then received in the now open firing chamber 38 as the frame and grip of the pistol are swung up into line with the shield 110. The frame 154 and grip 42 are then forced backward on release of the compression in the recoil spring 68, thus locking the action locking arm 26 and lug 28 into the firing chamber, with the lug received in and centered within barrel face 58.

Removing the pistol 36 from locking assembly 109 requires adult upper body strength which, especially if the locking assembly is not being worn as a holster, makes it extremely difficult for children to remove the pistol 36 from locking assembly 109. Further, with the locking pin 146 and lock 150 in place, it is virtually impossible to withdraw the empty pistol 36 from locking assembly 109. By contrast, with an ordinary holster having snaps and straps, an unloaded pistol can easily be withdrawn and cartridges inserted thereafter.

Figure 25:
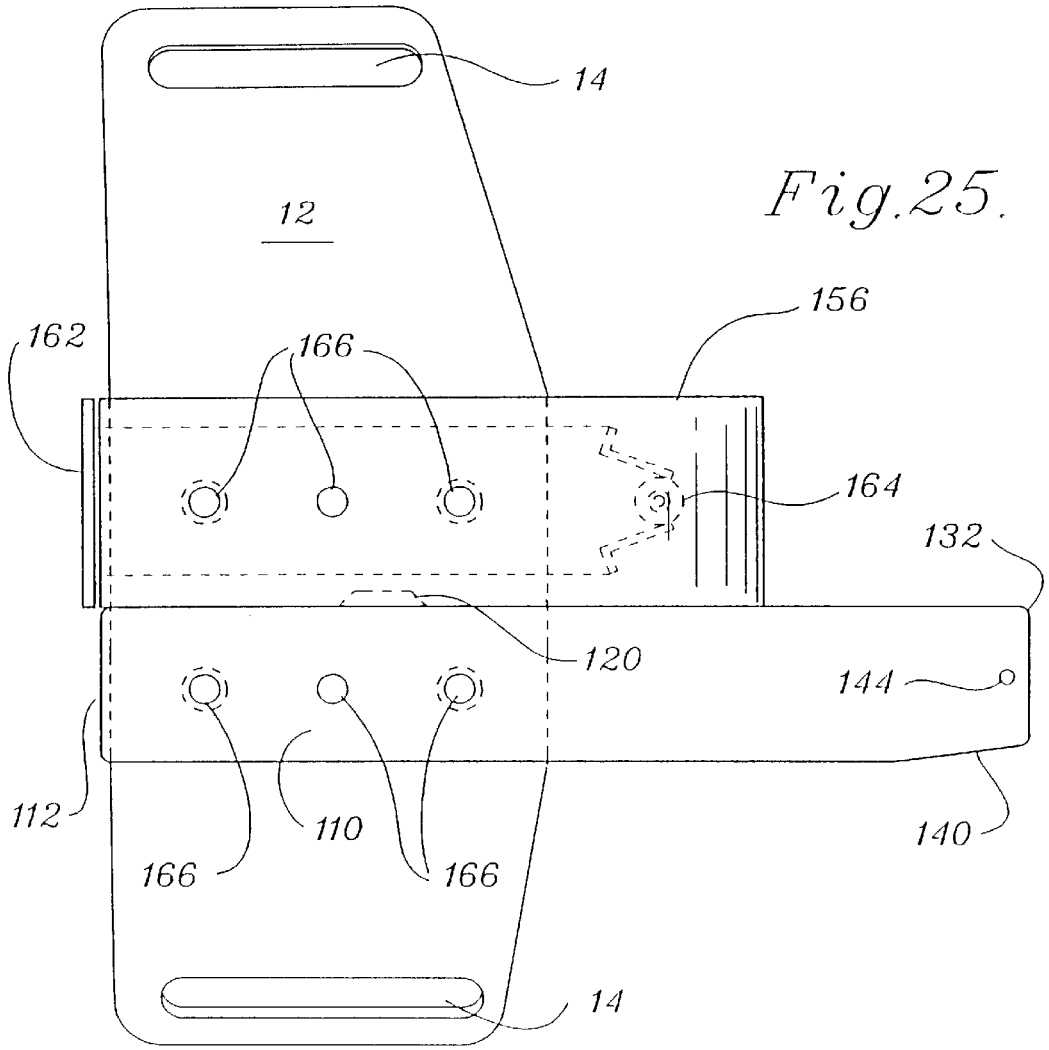
FIG. 25 is a side elevation view of a locking assembly and a magazine storage assembly according to the invention.
Figure 26:
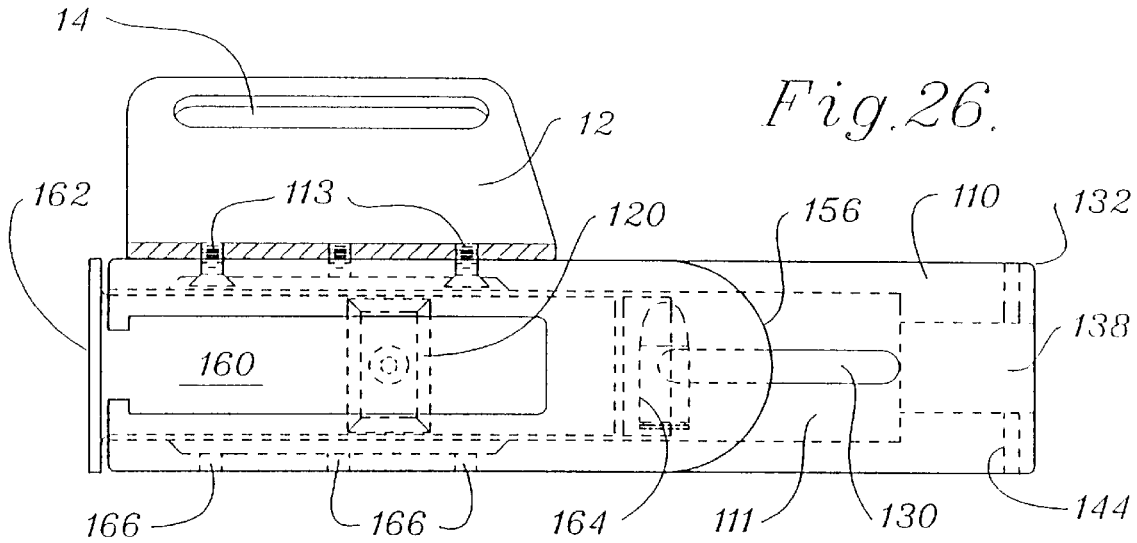
FIG. 26 is a top view of the locking assembly and magazine storage assembly of FIG. 25.
Figure 27:
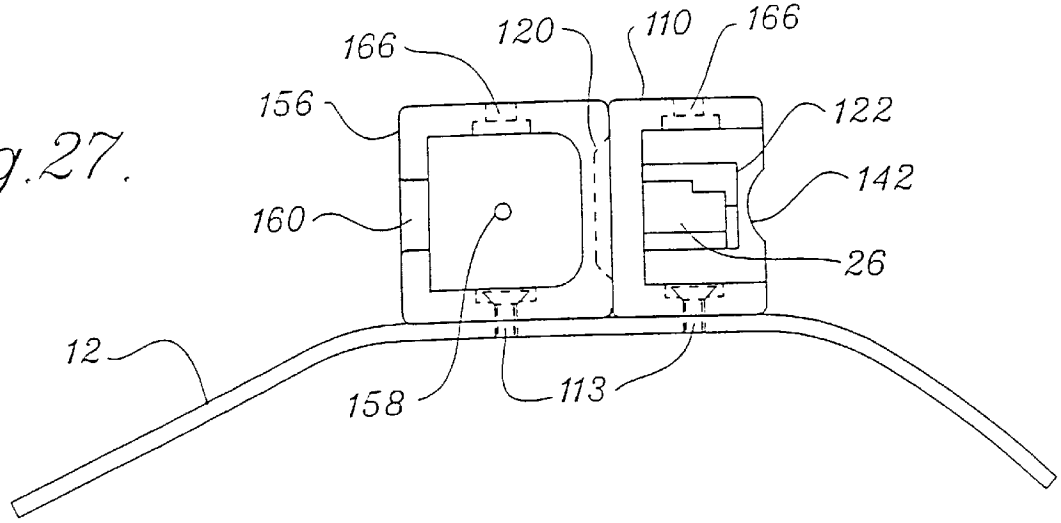
FIG. 27 is an end view of the locking assembly and magazine storage assembly of FIG. 25.

Referring to FIGS. 25–27, the locking assembly 109 may be coupled with a magazine storage assembly 156 so that spare magazines may be carried with the pistol. Assembly 156 has a drain hole 158 for allowing any moisture to pass through the assembly without fouling the ammunition therein. The assembly 156 has a slot 160, facilitating removal of the magazine by hand.

A magazine 162 is shown having cartridges 164 therein. The magazine 162 is inserted in the magazine storage assembly 156. It will be understood by those of ordinary skill in the art that magazine storage assembly 156 will be custom manufactured to suit the dimensions and to provide a snug fit for magazines and cartridges of varying models. The magazine storage assembly 156 is so configured so that it will accept the spare magazine in only one position thereby assuring that when the spare magazine is withdrawn from the storage assembly 156, the magazine will be always in the proper cartridges forward position so as to be able to be rapidly inserted within the magazine well without any chance of wrong end forward.

Figure 28:
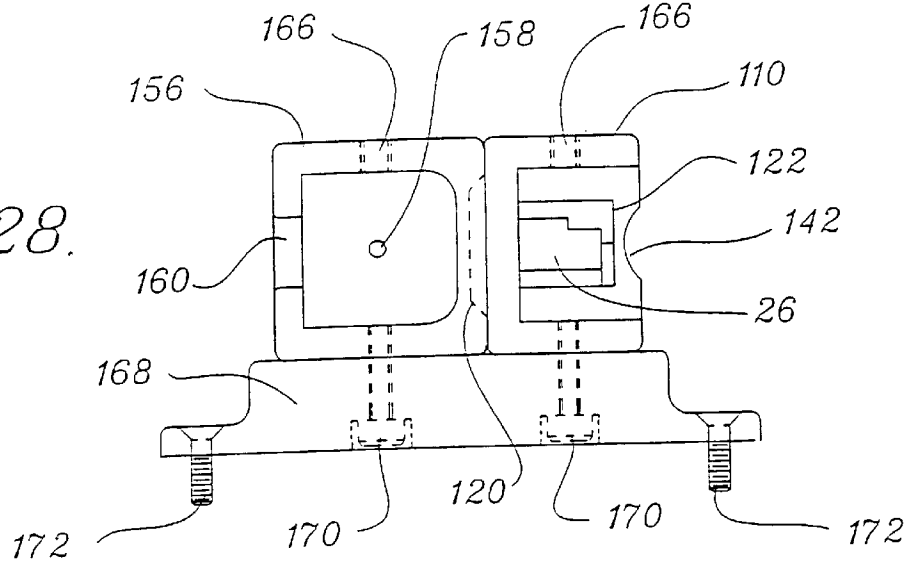
FIG. 28 is an end view of a locking assembly and magazine storage assembly on a mounting base according to the invention.

Magazine storage assembly 156 and shield 110 may be provided with alternate mounting holes 166 so that each component may be reversed on the same body plate 12. Thus, separate left- and right-hand holsters and assemblies need not be manufactured, since the shield 110 and assembly 156 may be mounted to suit both right-handed and left-handed users. This is a significant manufacturing and administrative cost saving, especially for armed forces and law enforcement organizations. Referring to FIG. 28, the magazine storage assembly 156 and slide shield 110 may alternatively be secured to a mounting base 168, which is in turn securable to a dashboard, a tank compartment, or the bulkhead of a vessel. Other possible mounting locations would include a safe, a closet, a car trunk, a drawer or other furniture or compartments so that the weapon can be safely stowed in a ready to load and use manner.

Bolts 170 and 172 are custom designed so that a special tool is required to remove them from the mounting plate 168.

As shown herein, the second embodiment of the invention is in use with a closed bolt semiautomatic pistol. However, the shield 110 could be modified to accept an open bolt automatic machine pistol simply by varying the dimensions of the shield, increasing the distance between arm 26 and slide block 134 and configuring the arm 26 and lug 28 to fit the open bolt chamber. This will be readily apparent to one skilled in the art upon reading the instant specification.

The unique action locking assembly of the present invention obviates the question whether or not the safety is on when the firearm is positioned within the holster. When a firearm is carried within the holster of the present invention, it is by design always without a chambered cartridge and is incapable of being fired, until the pistol is withdrawn from the holster. When holstered, the wearer may disengage the safety on his or her weapon with confidence that the weapon cannot accidentally fire. This enhanced safety and rapid deployment feature of the present invention is unavailable from the prior art holsters. The position of the action locking arm 26 and lug 28 within the chamber of the firearm positively blocks and renders inoperative the trigger while the firearm is within the holster. The present invention not only assures a positive and safe locked carry method, but it also permits the rapid deployment of the firearm, ready to fire, by the use of only one hand. The ability to safely deploy a weapon with only one hand during a crisis situation allows wounded military or law enforcement personnel to actively defend themselves.

The present invention affords maximum concealability of even fully automatic weapons, without compromising safety and immediate access and deployment of the weapon.

Having described the embodiments of the invention, it will be understood that certain variations to the above-described embodiments may be made with the same results and without departing from the spirit and scope of the invention. For instance, various arrangements to wear the holster with a belt or with a shoulder harness for underarm use, in addition to the openings 14 shown and described above, will be obvious to those skilled in the art. The body plate and support member or slide shield may be integrally manufactured or molded as one piece. The foregoing description and drawings are not intended to limit the invention, so that the scope of the invention may only be ascertained by reading the following claims.

I claim:

1. A locking assembly for a firearm having a firing chamber, a barrel and a spring-loaded, reciprocating slide element, said barrel having a barrel face and a muzzle end, said slide element having a muzzle end, said locking assembly comprising:

an action locking arm carrying a lug, said lug receivable in the firing chamber and barrel face of said firearm;

a slide element blocking device spaced from and structurally connected with said action locking arm, said slide element blocking device having an opening for passage of the muzzle end of said barrel therethrough;

the muzzle end of said barrel extendable through said opening when the muzzle end of said slide element is placed in contact with said slide element blocking device;

whereby when said lug is received in said barrel face and the muzzle end of said slide element is in contact with said slide element blocking device, said firearm is retained in said locking assembly.

2. The locking assembly of claim 1 wherein said locking assembly is incorporated in a holster.

3. The locking assembly of claim 1 including a slide shield supporting and extending between said action locking arm and said slide element blocking device.

4. The locking assembly of claim 3 wherein said slide shield has a rectangular cross-section with an open end opposite said slide element blocking device and an open side opposite said action locking arm, said slide element and said barrel of said firearm receivable in the open end and open side of said slide shield.

5. The locking assembly of claim 1 wherein said slide element blocking device comprises a slide block having a barrel port therethrough.

6. The locking assembly of claim 5 wherein said slide block has an angled surface and includes a groove on the angled surface to provide clearance for said firearm.

7. The locking assembly of claim 5 including a lock bar received in said slide block and extending through and perpendicular to said barrel port.

8. The locking assembly of claim 5 including alternate mounting holes on said slide shield to facilitate use of the same slide shield by both left-handed and right-handed users.

9. The locking assembly of claim 1 further including a magazine storage assembly adjacent said locking assembly.

10. The locking assembly of claim 9 wherein said magazine storage assembly has a slot for facilitating removal of a cartridge magazine from the magazine storage assembly and a drain hole for draining moisture from the magazine storage assembly, and wherein the magazine storage assembly is so configured as to assure that cartridges are oriented in a proper direction when a spare magazine is withdrawn from the magazine storage assembly for insertion into said firearm.

11. The locking assembly of claim 5 wherein said action locking arm is secured to said slide shield by a bolt with a customized head, and further including a dowel extending between said action locking arm and said slide shield to prevent relative rotation of the action locking arm.

12. The locking assembly of claim 5 including a groove on said slide shield to provide clearance for a slide lock on said firearm.

13. The locking assembly of claim 1 wherein said action locking arm includes an ejector bypass and a firing pin bypass.

14. The locking assembly of claim 1 wherein said locking assembly is attached to a mounting base.

15. The locking assembly of claim 5 including a sight slot on said slide shield.

16. A locking assembly for a firearm having a firing chamber, a barrel and a spring-loaded, reciprocating slide element, said barrel having a barrel face and a muzzle end, said slide element having a muzzle end, said locking assembly comprising:

a slide shield;

an action locking arm carrying a lug, said lug receivable in the firing chamber and barrel face of said firearm, said action locking arm attached to and positioned within said slide shield;

a slide block attached to said slide shield and spaced from said action locking arm and lug, said slide block having a barrel port for passage of the muzzle end of said barrel therethrough;

the muzzle end of said barrel extendable into said barrel port when the muzzle end of said slide element is placed in contact with said slide block;

whereby when said lug is received in said firing chamber and said barrel face, said muzzle end of said barrel is received in said barrel port and said slide element is in contact with said slide block, said firearm is retained in said locking assembly.

17. The locking assembly of claim 16 wherein said slide shield has a rectangular cross section with an open end opposite said slide block and an open side opposite said action locking arm, said slide block and said barrel of said firearm receivable in the open end and open side of said slide shield.

18. The locking assembly of claim 16 wherein said slide block has an angled surface and includes a groove on the angled surface to provide clearance for said firearm.

19. The locking assembly of claim 16 wherein said action locking arm is secured to said slide shield by a bolt with a customized head, and further including a dowel extending between said action locking arm and said slide shield to prevent relative rotation of the action locking arm.

20. The locking assembly of claim 16 including a groove on said slide shield to provide clearance for a slide lock on said firearm.

21. The locking assembly of claim 16 wherein said action locking arm includes an ejector bypass and a firing pin bypass.

22. The locking assembly of claim 16 including a sight slot on said slide shield.

23. The locking assembly of claim 16 wherein said slide shield has a rectangular cross-section and said slide block is integral with said slide shield.

24. A locking assembly for a firearm having a firing chamber, a barrel and a spring-loaded, reciprocating slide element, said barrel having a barrel face and a muzzle end, said slide element having a muzzle end, said locking assembly comprising:

a rectangular slide shield;

an action locking arm attached to a top wall of and positioned within said slide shield, said action locking arm fixed against rotation relative to said top wall, said action locking arm extending downward from said top wall and having an ejector bypass and a firing pin bypass on a lower surface of said action locking arm;

a lug extending from said action locking arm in a direction substantially parallel to said top wall, said lug receivable in the barrel face of said firearm;

a slide block on said slide shield spaced from said action locking arm and lug, said slide block having a barrel port therethrough, with a grooved, angled surface on a lower portion of said slide block;

an open end on said slide shield spaced from said slide block;

an open side on said slide shield opposite said top wall;

mounting holes on said slide shield;

a slide lock clearance groove on said slide shield; and a sight slot in said top wall of said slide shield;

whereby when said firearm slide element is received in said slide shield via said open end and open side of said slide shield, said muzzle end of the slide element is placed in contact with said slide block, said muzzle end of said barrel is received in said barrel port and said lug is received in said barrel face, the firearm is retained in said locking assembly.

* * * * *